US007618019B2

(12) United States Patent
van der Meijden et al.

(10) Patent No.: US 7,618,019 B2
(45) Date of Patent: Nov. 17, 2009

(54) AUTOMATIC SWIMMING POOL CLEANERS AND COMPONENTS THEREOF

(75) Inventors: Hendrikus Johannes van der Meijden, Midrand (ZA); Michael Edward Moore, Westdene (ZA); Peter Hugh Harrison, Centurion (ZA); Alexis Adrian Felipe Wadman, Amstelveen (NL); Mark J. Bauckman, Carlsbad, CA (US)

(73) Assignee: Zodiac Pool Care Europe, SAS (FR)

( * ) Notice: Subject to any disclaimer, the term of this patent is extended or adjusted under 35 U.S.C. 154(b) by 0 days.

(21) Appl. No.: 12/020,610

(22) Filed: Jan. 28, 2008

(65) Prior Publication Data

US 2008/0115299 A1 May 22, 2008

Related U.S. Application Data

(62) Division of application No. 10/917,587, filed on Aug. 13, 2004, now Pat. No. 7,337,803.

(51) Int. Cl.
*E04H 4/16* (2006.01)
*F03B 11/00* (2006.01)

(52) U.S. Cl. ..... 251/366; 15/1.7

(58) Field of Classification Search ..... 137/561 R; 251/366, 367, 368; 15/1.7
See application file for complete search history.

(56) References Cited

U.S. PATENT DOCUMENTS 3,710,942 A * 1/1973 Rosenberg ..... 137/854
4,642,833 A 2/1987 Stoltz et al.
4,742,593 A 5/1988 Kallenbach
5,315,728 A 5/1994 Atkins
5,450,645 A 9/1995 Atkins
5,542,141 A 8/1996 Albright
5,660,802 A 8/1997 Archer et al.
5,970,557 A 10/1999 Supra
6,273,128 B1 * 8/2001 Paczonay ..... 137/512.3
6,473,928 B1 11/2002 Veloskey et al.

FOREIGN PATENT DOCUMENTS

EP 0205697 12/1986
WO WO 02/01022 1/2002

OTHER PUBLICATIONS

International Search Report in PCT/US2005/028683 dated Jan. 12, 2006.

* cited by examiner

*Primary Examiner*—Kevin L Lee
(74) *Attorney, Agent, or Firm*—Dean W. Russell; Kilpatrick Stockton LLP

(57) ABSTRACT

Devices for cleaning vessels, especially swimming pools, are discussed. The devices may include a non-linear flow path in a gap surrounding an in-line valve. This non-linearity permits lengths of concentric pipes forming the gap to be decreased without sacrificing operational performance of the devices. Valves forming parts of the cleaning devices may be diaphragms but shaped, sized, reinforced, or configured differently than existing valves and may have collapsible segments whose interior shape resembles an ellipse in transverse cross-section. Co-molding of diaphragms and pipes may occur, and inner and outer cups may be used to fix relative positions of various components of the devices.

17 Claims, 11 Drawing Sheets

AUTOMATIC SWIMMING POOL CLEANERS AND COMPONENTS THEREOF

CROSS-REFERENCE TO RELATED APPLICATION

This application is a divisional application of U.S. patent application Ser. No. 10/917,587 filed on Aug. 13, 2004, now allowed, the contents of which are incorporated herein by reference.

FIELD OF THE INVENTION

This invention relates to devices for cleaning fluid-containing vessels and more particularly, but not exclusively, to automatic cleaners for swimming pools and components of such cleaners.

BACKGROUND OF THE INVENTION

Commonly-owned U.S. Pat. No. 4,642,833 to Stoltz, et al. (the "Stoltz Patent") discloses various valve assemblies useful for automatic swimming pool cleaners. These assemblies typically include flexible diaphragms surrounded by chambers, with the diaphragms interposed in the fluid-flow paths (i.e. "in-line") through the cleaners. In response to variation in pressure internally and externally, the diaphragms contract and expand transversely along at least part of their lengths, thereby controlling fluid flow therethrough.

Typical diaphragms of the Stoltz Patent are tubular and made of an elastic material. As noted in the Stoltz Patent:

> Where the tubular member is made from elastic material it may be made to have a downstream portion less elastic than the remainder and the length of the less elastic part of the tubular member may vary circumferentially adjacent the more elastic portion and the tubular member may be reinforced with fabric or other stranded material.

See Stoltz Patent, col. 1, 11. 62- 68. Also described in the Stoltz Patent are inner circumferential ribs "extending along substantially 180° of the surface of the diaphragm and on opposite sides thereof." Id., col. 2, 11. 38-40 (numeral omitted). These circumferential ribs facilitate closing the diaphragms so as to prevent fluid from flowing therethrough. See id., col. 3, 11. 20-22.

Commonly-owned U.S. Pat. No. 4,742,593 to Kallenbach (the "Kallenbach Patent") discloses additional valve assemblies for use with automatic swimming pool cleaners. These assemblies, also typically tubular and of flexible material, too may be interposed in-line, within the fluid-flow paths of such cleaners. According to the Kallenbach Patent:

> The body [of the tubular valve] has an intermediate section between the ends that assumes a substantially collapsed condition over a segment thereof in absence of a pressure differential between the interior and exterior. The section preferably is collapsed transversely over a segment.
>
> Along the collapsed segment, the body has diverging interior walls in the direction of water flow therethrough. The walls diverge from a substantially constant diameter that extends for a portion of the section adjacent the first end to a substantially constant, but larger, diameter that extends for a portion of the section adjacent the second end. Further, the divergence is a substantially linear function of the distance along the segment.

See Kallenbach Patent, col. 1, 11. 28-42. Also noted in the Kallenbach Patent is that > The section may be provided with longitudinal reinforcing ribs on each side extending from near the second end to the collapsed segment.
>
> Further, vertical ribbing may be provided on the interior of the section on opposing surfaces proximate the collapsed segment.

Id. at 11. 43-47. At least some of the longitudinal ribs are designed to "serve as a means for stiffening the valve member in the axial or longitudinal direction." Id, col. 3, 11. 53-55.

International Publication No. WO 02/01022 of Kallenbach, et al. (the "Kallenbach Publication"), entitled "Swimming Pool Cleaner," details another cleaner in which a valve periodically interrupts a flow of water through the body of the cleaner. Included in the cleaner are a main flow path and a by-pass passage built into the body. See Kallenbach Publication, p. 5, 11. 8-11. Also included in one version is an "annular resilient rolling diaphragm" with an edge "located in sealing engagement with the inner wall of the body." Id., p. 6, 11. 24-26. However, a dome-shaped valve closure member, rather than the rolling diaphragm, operates to interrupt fluid flow through the main path. Additionally, neither the rolling diaphragm nor the dome-shaped member is interposed in-line in the main water path from the inlet passage of the cleaner to the outlet of the body.

Each of the Stoltz and Kallenbach Patents and the Kallenbach Publication discusses "suction-side" cleaners in which a pair of concentric pipes exist, the outer of the pipes being adapted for connection to a flexible hose leading (directly or indirectly) to the inlet, or "suction side," of a pump. An annular gap between the pipes permits water to flow through the by-pass passage of the cleaner of the Kallenbach Publication toward the flexible hose. A similar gap in versions of cleaners discussed in the Stoltz and Kallenbach Patents offers "suction communication . . . through slots [in a plate] to [a] chamber" defined at least in part by the tubular members of these patents. The contents of the Kallenbach Publication, together with those of the Stoltz and Kallenbach Patents, are incorporated herein in their entireties by this reference.

SUMMARY OF THE INVENTION

The present invention provides alternatives to the devices addressed in these earlier efforts. Among features of the present invention are provision of a non-linear fluid flow path in an annular gap of a cleaner having an in-line valve. Hence, although the main flow path through a diaphragm-type valve may continue to be linear, the flow path associated with the annular gap need not be. Introducing non-linearity into this path permits the lengths of the concentric pipes, or conduits, to be decreased without sacrificing operational performance of the associated cleaners. The decreased lengths indeed often improve operational performance of the cleaners, as shorter pipes are less likely to be guided, or led, by the flexible hoses to which they are attached. Better power to weight ratios also exist for the cleaners because of the diminished material needed for the pipes.

Beneficially (but not necessarily), any such non-linearities will occur adjacent the valve. Preferably, moreover, the principal non-linearity will constitute a direction reversal in the form of a turn of approximately one hundred eighty degrees. Non-linearities of this sort are not the sole ones contemplated by the present invention, however; instead, helical or spiral paths, turns of other magnitude, etc., may be employed as appropriate or desired.

Flexible valve assemblies of the present invention additionally may differ from those of the Stoltz and Kallenbach Patents and the Kallenbach Publication. Unlike the diaphragms and closure members of the Kallenbach Publication, for example, valves of the invention may be positioned in-line in the main fluid flow path through the cleaners. Further, these valves may (but need not) be tubular, like many of the diaphragms detailed in the Stoltz and Kallenbach Patents. However, valves of the present invention may be shaped and sized differently than the diaphragms illustrated in the Stoltz and Kallenbach patents and may be of greater rigidity in their upper (downstream) sections. In some embodiments, longitudinally-oriented pins may be inserted into the valves for rigidity, while in other embodiments plastic material of low modulus of flexibility (substantially rigid thermoplastics, for example) may be used for this purpose. Respecting these latter embodiments, the plastic material may be the same as that used for the inner pipe, which is commonly considered to be rigid.

The innovative valves additionally assume a substantially elliptical internal transverse cross-section in the collapsible segments when such segments are collapsed, unlike the complex but substantially rectangularly cross-sectioned collapsed shapes of prior tubular diaphragms. This change permits greater fluid flow through collapsed segments of the valves without diminishing the power provided for cleaner movement by the repeated collapses. Combined with the greater rigidity described in the preceding paragraph, the change also results in less energy being required to expand the collapsed segments and the segments opening to greater extent before returning to collapsed positions.

Valves of the present invention may be co-molded with the inner pipes to which they normally attach. So doing may avoid the need for an attachment joint between these components of an automatic swimming pool cleaner. Avoiding an attachment joint in turn may avoid component portions at such joint from wearing frictionally because of contact of the differing materials.

Finally, novel mechanisms may be employed to maintain relative positions of the inner and outer pipes and the valves. Inner and outer "vessels," or "cups," may comprise components of the cleaners, with the inner cup attaching to the valve near where the valve attaches to the inner pipe. The outer pipe then attaches to the valve at the opposite end, and teeth (serrations) present on spacers on the exterior surface of the inner cup engage serrated openings in the outer cup. Positioned and fixed in this manner, the inner cup may form an annular wall having a lip about which fluid may turn to create the non-linear flow path.

It thus is an optional, non-exclusive object of the present invention to provide innovative cleaning devices for fluid-containing vessels.

It also is an optional, non-exclusive object of the present invention to provide such devices in the form of automatic cleaners of swimming pools.

It further is an optional, non-exclusive object of the present invention to provide automatic swimming pool cleaners with in-line valves and annular gaps into which fluid may flow non-linearly.

It additionally is an optional, non-exclusive object of the present invention to provide automatic swimming pool cleaners having shorter pipes than presently used with suction-side cleaners, reducing the ability of associated flexible hoses to steer the cleaners within the pools.

It is, moreover, an optional, non-exclusive object of the present invention to provide cleaners with tubular valves shaped, sized, configured, or reinforced differently than existing diaphragms used for similar purposes.

It is another optional, non-exclusive object of the present invention to provide cleaners with collapsible segments that assume substantially elliptical internal cross-sectional shapes when collapsed.

It is an additional optional, non-exclusive object of the present invention to provide cleaners having valves that may be co-molded with pipes to which they normally attach.

It is yet another optional, non-exclusive object of the present invention to provide mechanisms for maintaining relative positions of inner and outer pipes and valves of suction-side automatic swimming pool cleaners.

Other objects, features, and advantages will be apparent to those skilled in the art with reference to the remaining text and the drawings of this application.

DETAILED DESCRIPTION

A. General Structure

Figure 1:
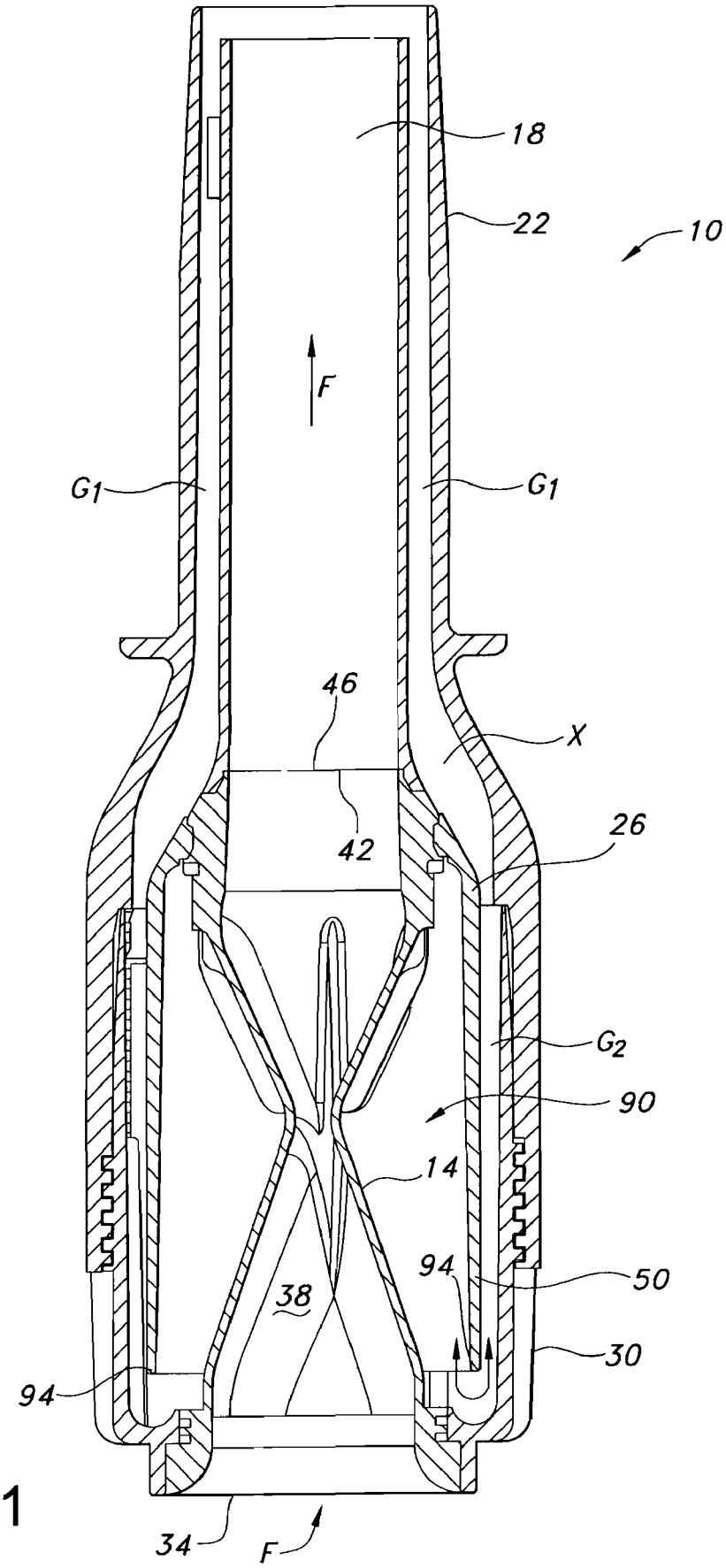
FIG. 1 is a cross-sectional view of an assembly comprising selected components of an automatic pool cleaner consistent with the present invention.
Figure 11:
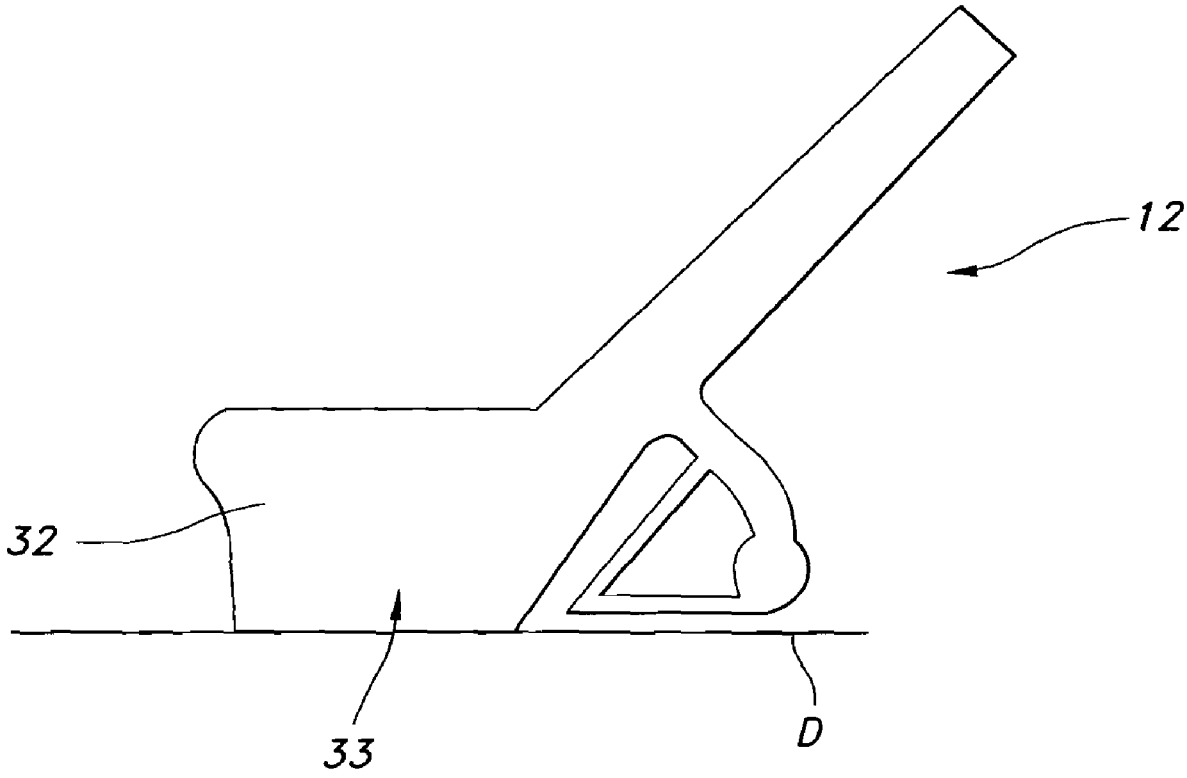
FIG. 11 is a schematicized depiction of an exemplary automatic pool cleaner into which the assembly of FIG. 1 may be incorporated.

Illustrated in FIG. 1 is assembly 10 adapted principally for use as part of an automatic swimming pool cleaner 12 (see FIG. 11). Included as part of assembly 10 are valve 14, inner pipe 18, outer pipe 22, inner cup 26 and outer cup 30. Valve 14 includes inlet 34, flow passage 38 therethrough, and outlet 42, the latter communicating with inlet 46 of inner pipe 18. Together, flow passage 38 and inner pipe 18 define a main fluid flow path through the associated automatic pool cleaner 12. In this respect valve 14 may be said to be "in-line," as its flow passage 38 forms part of the main flow path of the cleaner.

As shown in FIG. 1, valve 14 may be connected to inner pipe 18 to ensure fluid communication between valve outlet 42 and inlet 46 of the inner pipe 18. Near outlet 42, valve 14 also may be connected to inner cup 26. While denominated a "cup," inner cup 26 is in the form of a vessel open at both ends 47 and 48, instead comprising generally cylindrical wall 50 tapering to shoulder 54. Inner pipe 18 and part of valve 14 may thus pass through opening 58 (FIG. 2) defined by shoulder 54 before being engaged by shoulder 54 near valve outlet 42. FIG. 3 illustrates the result of this engagement, in which the tapering of inner cup 26 helps clamp together valve 14 and inner pipe 18.

Figure 2:
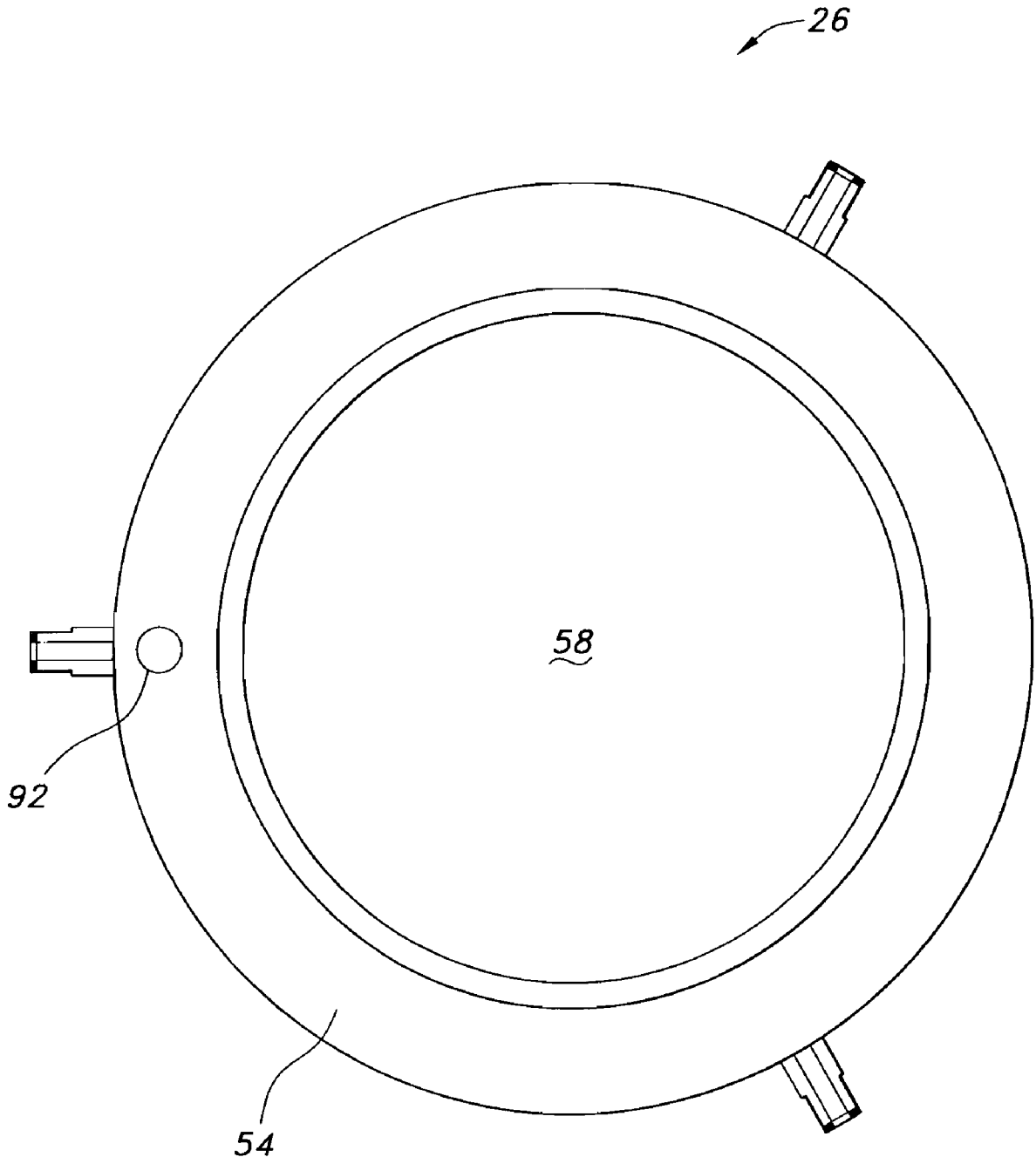
FIG. 2 is a top view of an inner cup of the assembly of FIG. 1.
Figure 3:
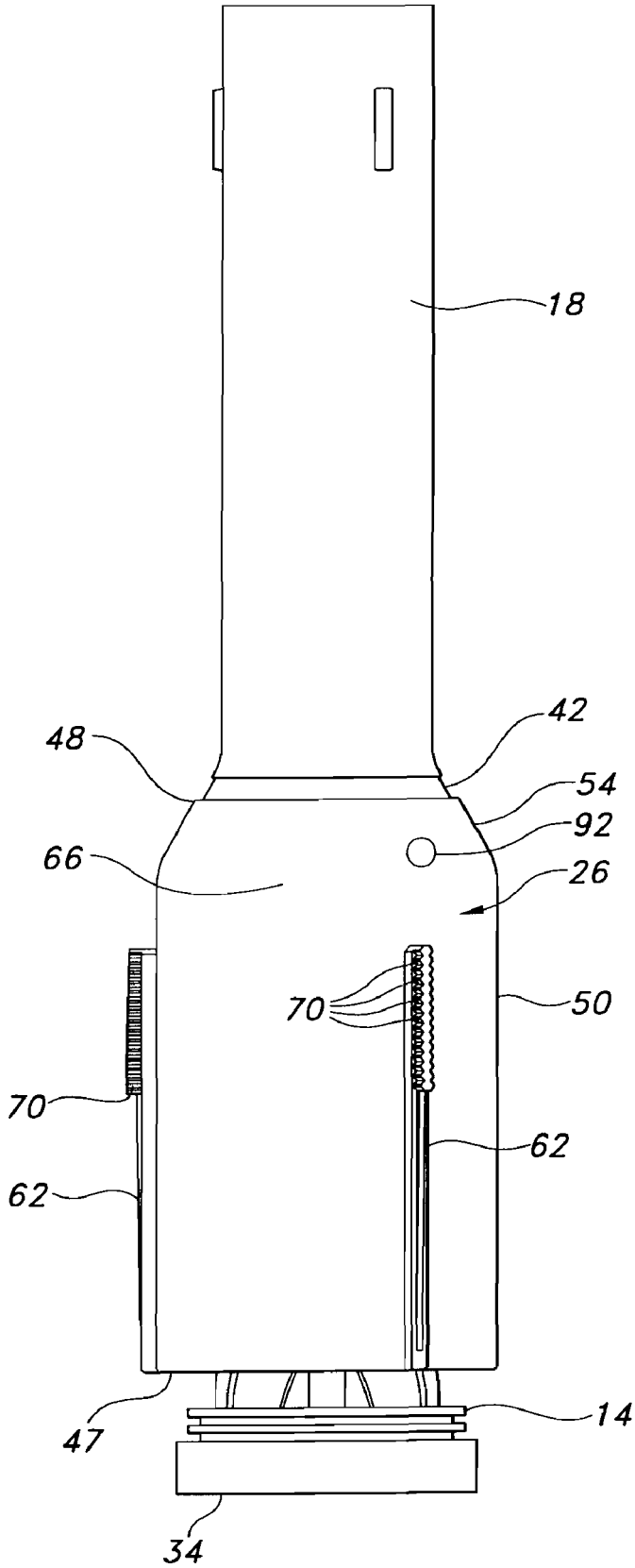
FIG. 3 is a plan view of portions of the assembly of FIG. 1.

Also depicted in FIGS. 1-3 are longitudinally-oriented spacers 62 protruding from exterior surface 66 of inner cup 26. In at least one embodiment of assembly 10, three spacers 62 are positioned approximately one hundred twenty degrees apart around the circumference of wall 50. Fewer or greater spacers 62 may be used instead, however, and such spacers 62 may be positioned or oriented other than as shown in FIGS. 1-3. Each spacer 62 advantageously includes serrations 70 in an area proximate shoulder 54 and end 48.

Figure 4:
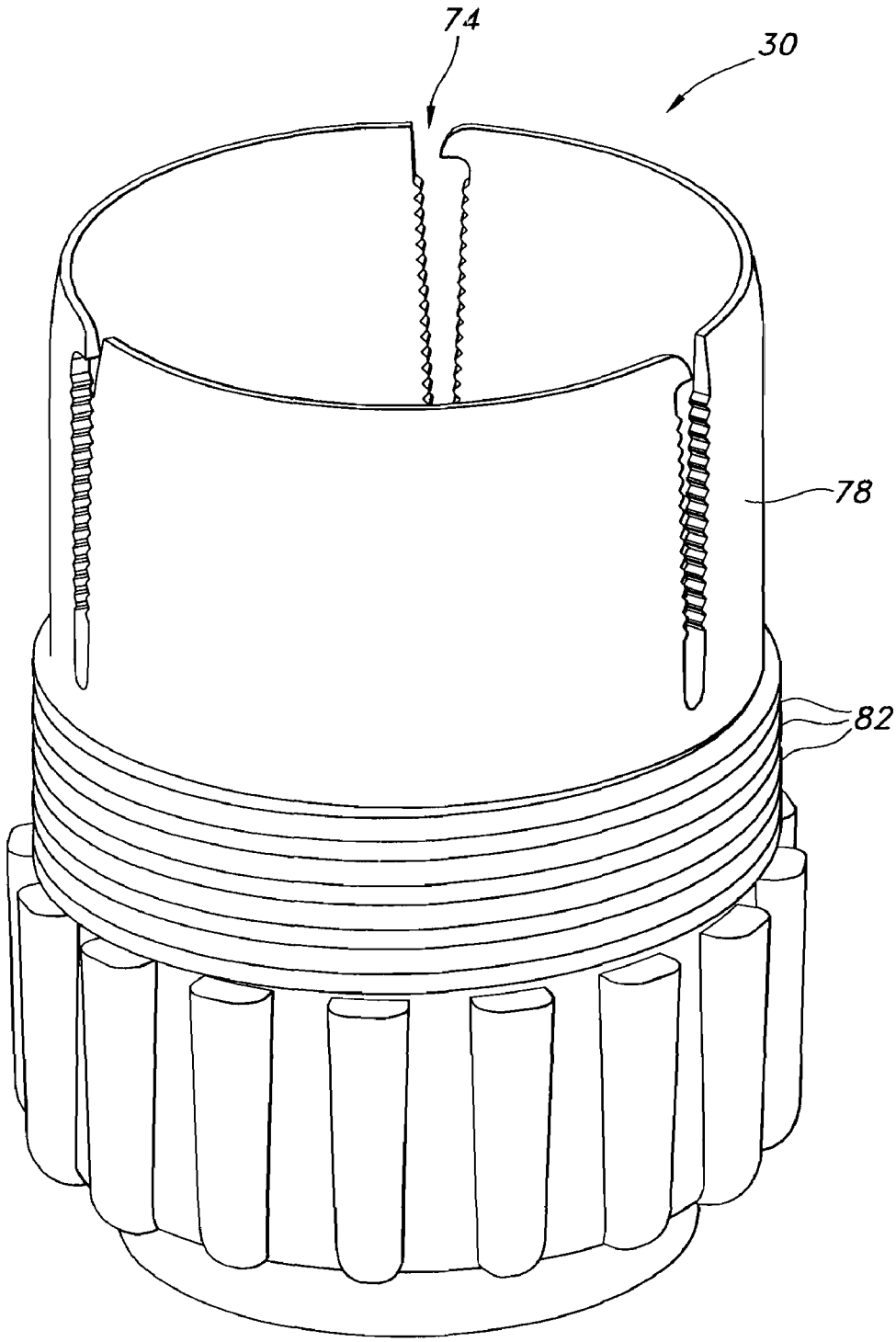
FIG. 4 is a perspective view of an outer cup of the assembly of FIG. 1.
Figure 5:
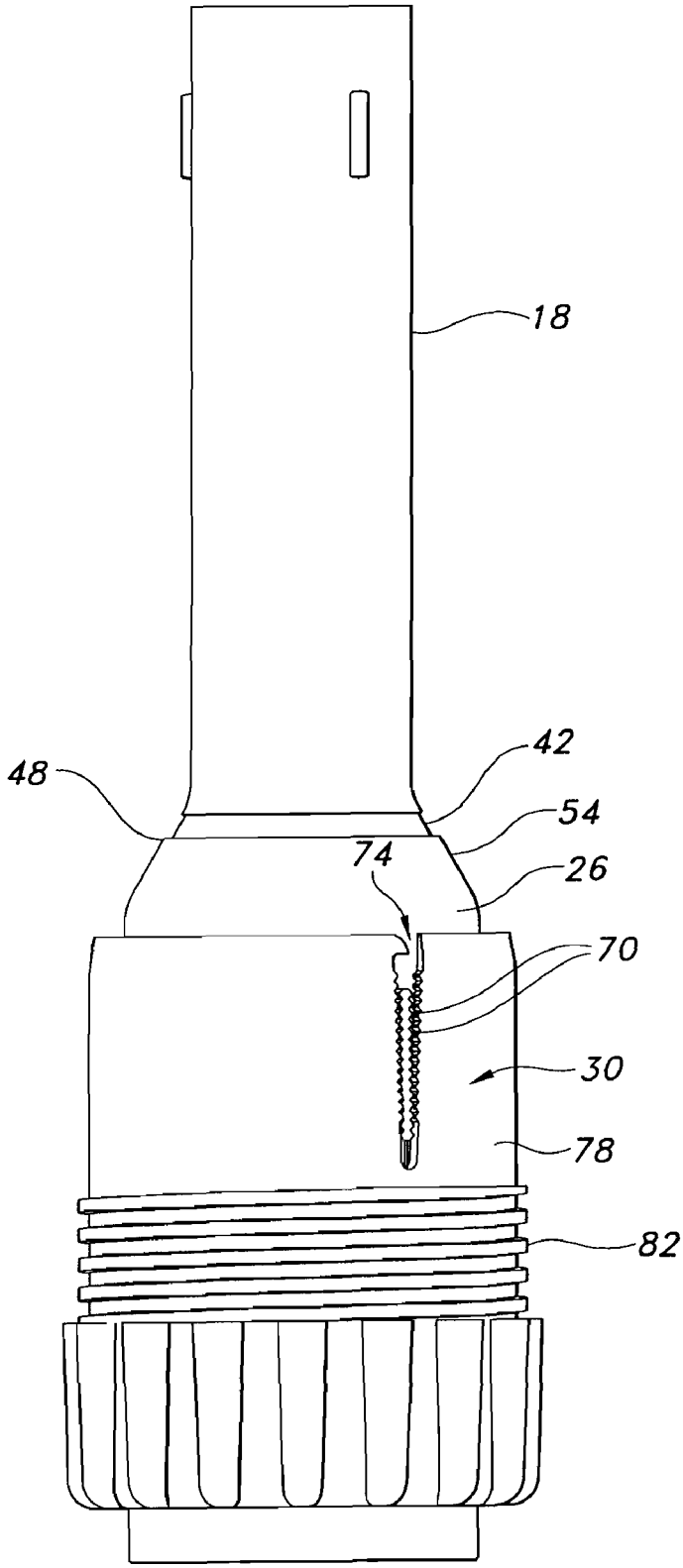
FIG. 5 is a plan view of portions of the assembly of FIG. 1.
Figure 6:
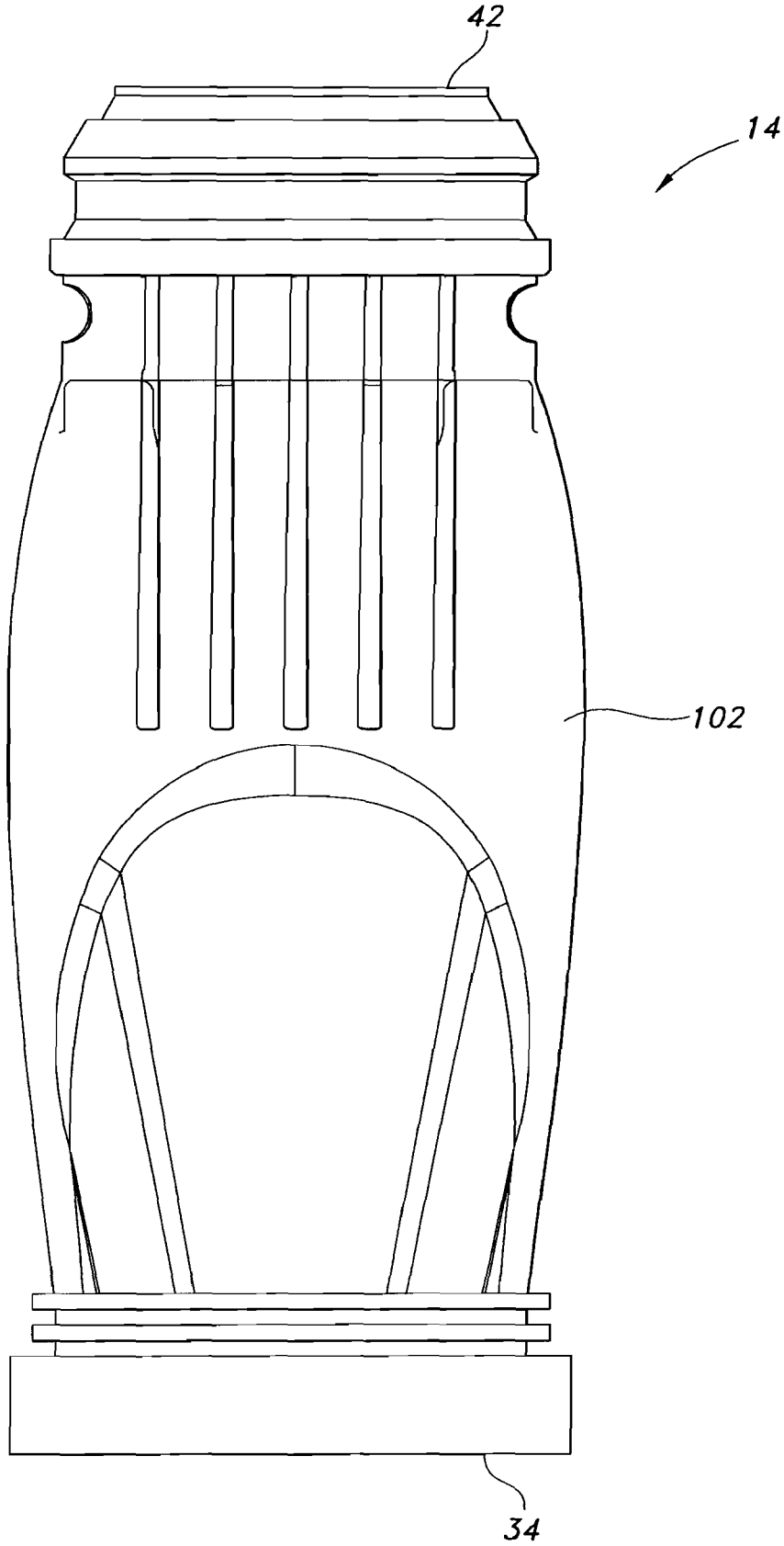
FIG. 6 illustrates, in plan view, a valve forming part of the assembly of FIG. 1.
Figure 7:
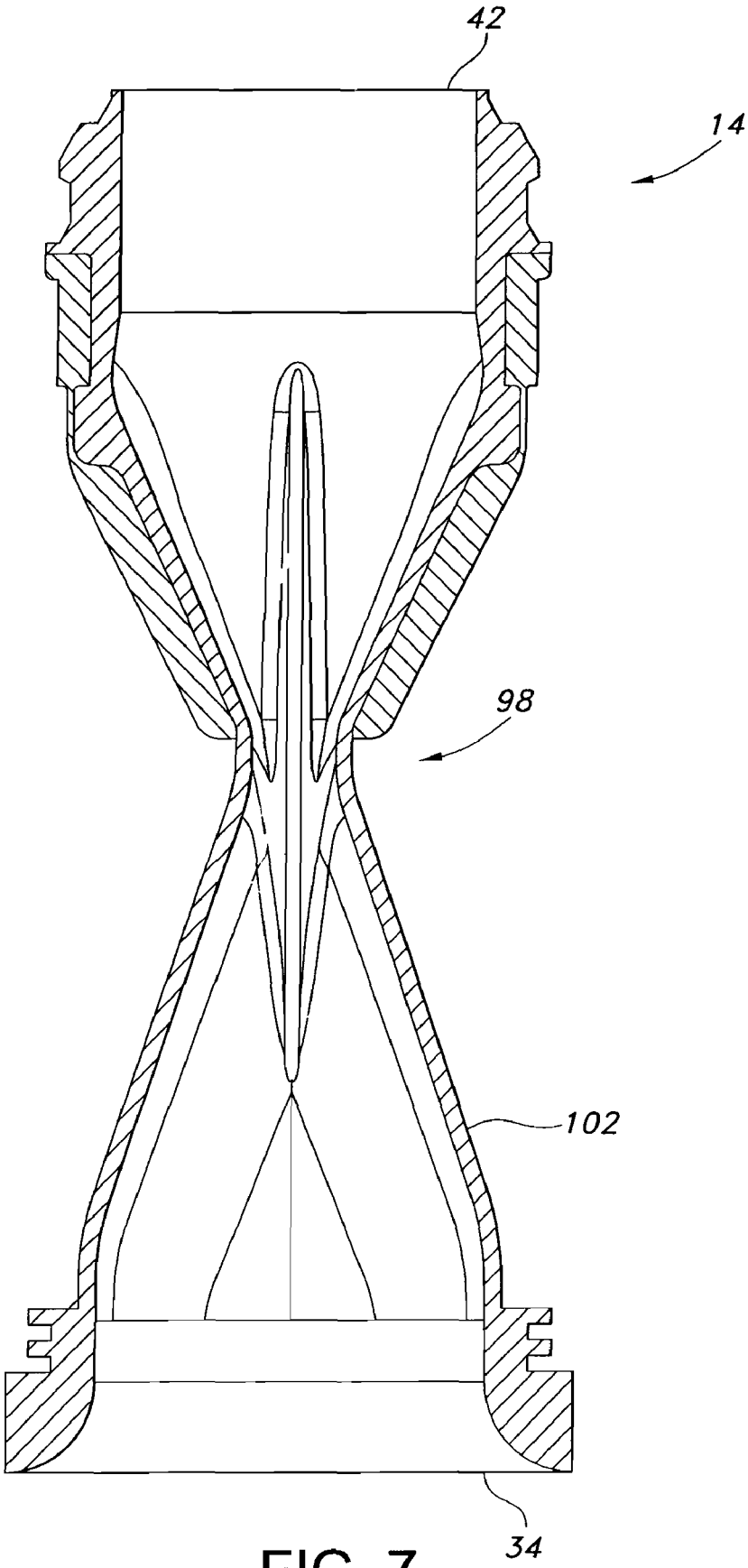
FIGS. 7-8 are cross-sectional views of the valve of FIG. 6.

Near valve inlet 34, valve 14 may be connected to outer cup 30 which, like inner cup 26, is in the form of a vessel open at its ends. Outer cup 30, as illustrated in FIGS. 4-5, is designed to fit over portions of wall 50, with circumferentially-spaced, serrated slots 74 receiving serrations 70 of spacers 62. This approach permits some initial (or subsequent) adjustment of the position of inner cup 26 relative to outer cup 30 upon application of sufficient force to slide spacers 62 along slots 74, while maintaining the relative positions of inner and outer cups 26 and 30 absent application of this force. FIG. 5 illustrates the result of slots 74 having received spacers 62, while both FIGS. 4-5 indicate that exterior surface 78 of outer cup 30 also may be threaded so as to include threads 82.

Outer pipe 22, finally, may be fitted over inner pipe 18. When outer pipe 22 is so fitted, its internal threads 86 engage threads 82 of outer cup 30 so as to connect outer pipe 22 to outer pipe 30. An inner tapered portion interfaces with surface 78, thereby collapsing it inward and causing serrated slots 74 to decrease in width and pinch tightly onto serrations 70 of spacers 62 so as to prevent further axial movement between inner cup 26 and outer cup 30. The result, as depicted in FIG. 1, is assembly 10, with relative positions of each of valve 14, inner pipe 18, outer pipe 22, inner cup 26, and outer cup 30 fixed.

B. Fluid Flow Paths

An automatic pool cleaner 12 utilizing assembly 10 may, like those of the Stoltz and Kallenbach patents, include a body 32 defining one or more fluid inlets 33 and to which a flexible disc D is directly or indirectly attached. Typically, fluid such as swimming pool water with entrained debris will be sucked into the cleaner through the fluid inlets. Thereafter, the debris-laden water will follow main fluid path F into inlet 34 of valve 14, through passageway 38 to outlet 42, into inlet 38 of inner pipe 18, and then through pipe 18 into a flexible hose.

Formed, however, within assembly 10 is chamber 90 surrounding valve 14. Chamber 90 acts in some respects as a reservoir, being filled with water through immersion in a swimming pool of the hose to which assembly 10 is connected. Such filling occurs by water flowing into the hose, through annular gap $G_1$ between inner and outer pipes 18 and 22, through annular gap $G_2$ between inner and outer cups 26 and 30, and thence into chamber 90. To facilitate priming of assembly 10, inner cup 26 may include one or more breather holes 92 to allow rapid evacuation of any air trapped in chamber 90 when initially immersed in water.

As the pump to which the hose is connected commences evacuating assembly 10, at least some water within chamber 90 is sucked back into gaps $G_1$ and $G_2$, which may constitute part or all of a secondary flow path. This action creates a pressure differential between chamber 90 and passageway 38 adequate to cause valve 14 to expand transversely, opening passageway 38 to allow passage of debris-laden water therethrough. Cyclical contraction and expansion of valve 14 thereafter occurs substantially as described in the Stoltz and Kallenbach patents.

Whereas the secondary flow paths shown in FIG. 11 of the Stoltz patent and FIG. 1 of the Kallenbach patent are effectively wholly linear, that of the present invention need not be. Instead, the secondary flow path has a substantial change of direction, essentially making a "U"-turn of approximately one hundred eighty degrees around lip 94 of wall 50 (as shown by the two-headed arrow in FIG. 1). Because wall 50 is cylindrical (and therefore lip 94 is circular), furthermore, this change of direction occurs throughout the three hundred sixty degrees spanned by the wall 50 and lip 94.

Accordingly, when valve 14 is in a collapsed condition, water or other fluid flowing from chamber 90 thus may travel downward in the depiction of FIG. 1, turn about lip 94, and then may flow upward in the depiction through gap $G_2$ essentially parallel to its original direction of travel. Thereafter the fluid may make a slight turn within area X identifying the intersection of gaps $G_1$ and $G_2$ and resume a course of travel through gap $G_1$ again essentially parallel to the prior portions of the travel path. When valve 14 is in its open state, water flows back into chamber 90, again changing direction when encountering lip 94.

Thus, if chamber 90 were the same size as the corresponding chambers of the Stoltz and Kallenbach patents, by the time any particular portion of a water stream would have exited chamber 90 and travelled the length of gap $G_2$, it would have travelled a significantly greater distance than to the corresponding points of the cleaners of the Stoltz and Kallenbach patents. Preferably instead, the non-linear secondary flow path of the invention permits chamber 90 to be substantially smaller than the corresponding chambers of the Stoltz and Kallenbach patent while providing an acceptably long secondary path for the water to flow.

In use when cleaning the floor of a pool, assembly 10 and both main flow path F and the second flow path through gaps $G_1$ and $G_2$ are not typically oriented completely vertically as shown in FIG. 1, but rather usually are oriented at an angle between thirty and sixty degrees from the vertical (and often approximately forty-five degrees). Nevertheless, having the non-linear secondary flow path permits decrease in the combined length of outer pipe 22 and chamber 90. Decreasing the length of rigid components of assembly 10 in turn allows for more random movement of the associated pool cleaner, as it reduces the leverage available to the hose that otherwise would tend to steer or lead the cleaner 12 within the pool.

Although the secondary flow path of FIG. 1 has a non-linearity in the form of a flow reversal, other such non-linearities may be used instead (or in addition). For example, the secondary flow path may be helical or spiral in shape in the area surrounding valve 14. Alternatively, it may assume a serpentine shape or include one or more curves or turns other than that shown in FIG. 1.

C. Valves

Illustrated in FIGS. 6-10 is an exemplary valve 14 of the present invention. Valve 14 is designed periodically to interrupt (or at least inhibit or restrict) the flow of fluid through main flow path F, thereby inducing movement of the associated cleaner 12. Valve 14 preferably, although not necessarily, comprises a generally tubular body made primarily of flexible, elastomeric material. Advantageously, valve 14 is a diaphragm molded principally of a thermoplastic elastomer of thirty to forty Shore A hardness, although it need not be molded or made of this material.

Like the valve member described in the Kallenbach patent, valve 14 beneficially includes section 98, intermediate inlet 34 and outlet 42, that assumes a substantially collapsed condition absent pressure differential between passageway 38 and exterior 102 of the valve 14. Additionally similar to the valve member of the Kallenbach patent, section 98 is collapsed transversely. However, unlike the valve member of the Kallenbach patent, whose intermediate segment assumes an essentially rectangular transverse cross-sectional shape when collapsed, section 98 may form a substantially elliptical shape in transverse cross-section, with curved rather than straight bounds. This cross-sectional shape of section 98 is well illustrated in FIG. 9 and allows greater flow through passageway 38 when section 98 is collapsed (thereby reducing clogging of passageway 38 with debris) without any significant loss of motive power to the cleaner 12.

Figure 8:
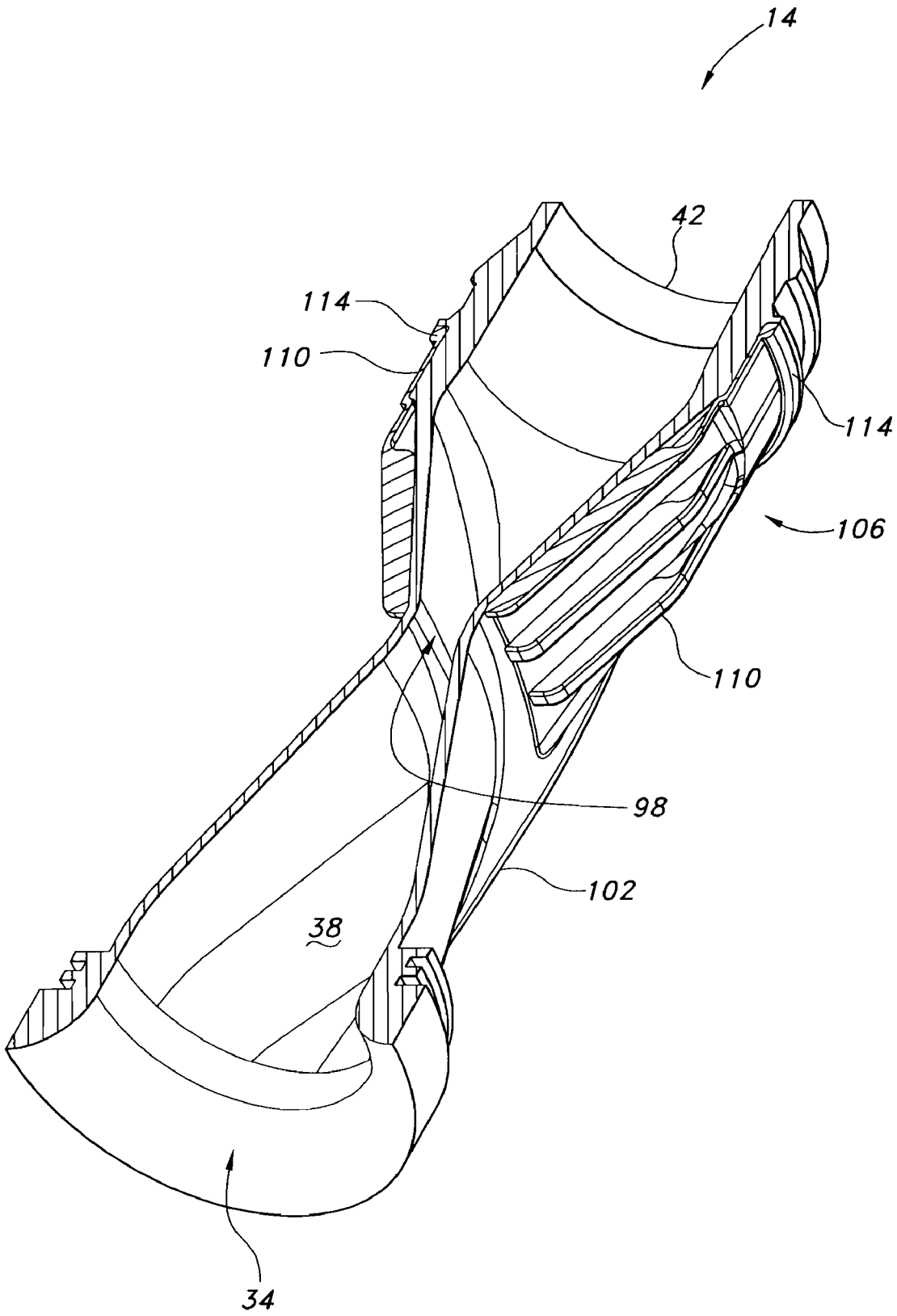
Figure 9:
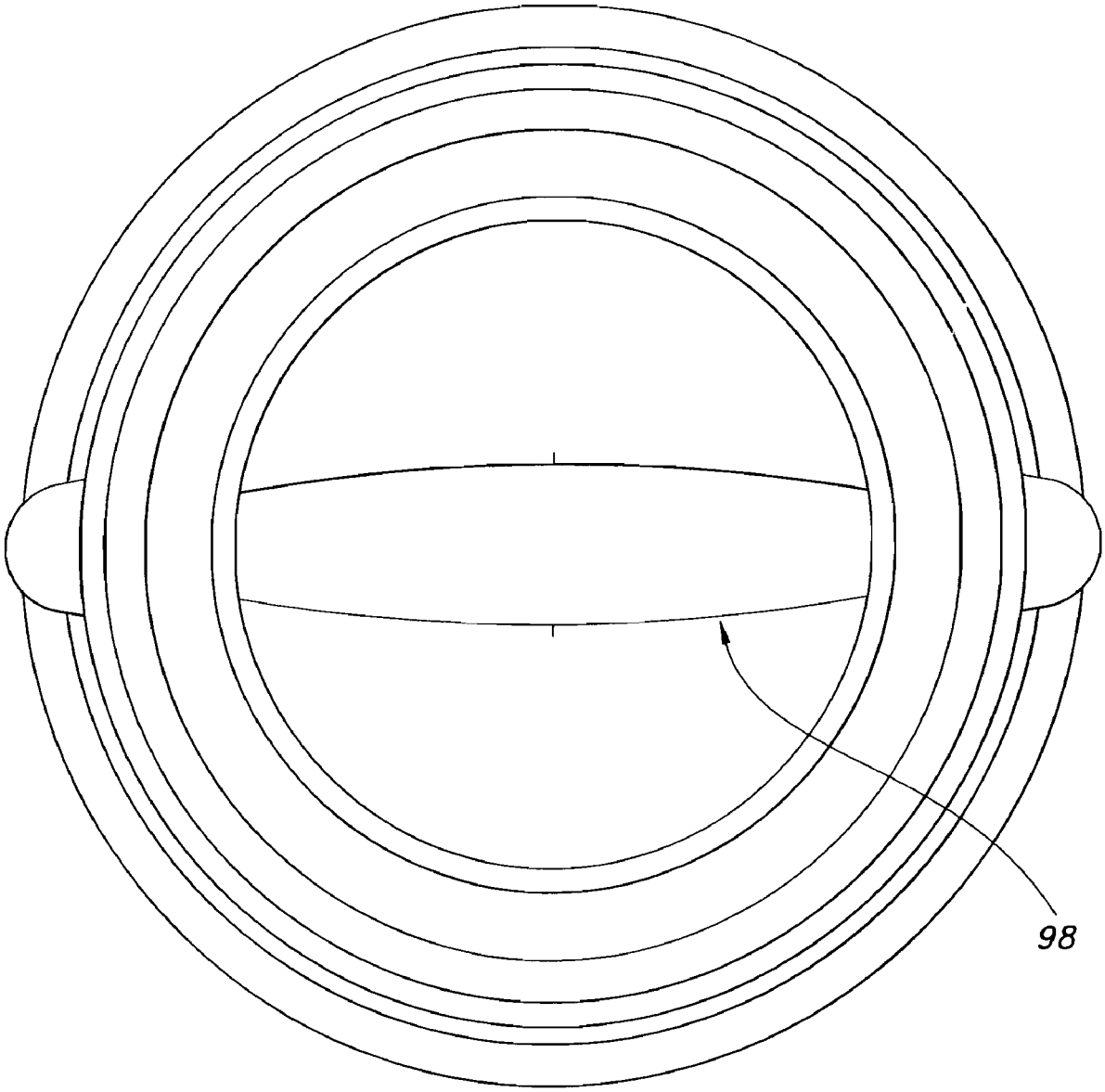
FIG. 9 is an end view of the valve of FIG. 6.

Also unlike the valve member of the Kallenbach patent, valve 14 may have an upper section 106 rigidized using a material different from that utilized for the remainder of the valve 14. Depicted especially in FIG. 8 are a plurality of longitudinal ribs 110 made of the more rigid material of which inner pipe 18 is formed. Also shown in the figure adjacent valve outlet 42 is band 14, which may extend about the circumference of upper section 105 and interconnect longitudinal ribs 110.

Ribs 110 tend to fan out as section 98 expands; for this reason and because of their lower modulus of flexibility, any or all of ribs 110 (and possibly band 114) help prevent collapse of upper section 106 when valve 14 is subject to differential internal and external pressures. Ribs 110 and band 114, or any of them, additionally may permit the remainder of valve 14 to be made of material softer (i.e. less rigid) than identified in the Kallenbach patent. This new composition of valve 14 requires less energy to open (expand) section 98 and causes the section 98 to open farther than the intermediate segment of the valve member of the Kallenbach patent before returning to its collapsed condition.

As noted above, ribs 110 beneficially may be formed of polypropylene or other material different from that from which the remainder of valve 14 is made. Such is not absolutely necessary, though. Instead, ribs 110 could be made of the same material as the remainder of valve 14 but with, perhaps, a greater thickness. Alternatively or additionally, metal or other rigid pins could be placed within or adjacent, or could constitute, ribs 110. Those skilled in the relevant field will recognize that other means for strengthening upper section 106 may also be employed.

Utilizing this construction additionally allows valve 14 to be substantially shorter than the valve member of the Kallenbach patent. A shorter valve 14 complements the fact that chamber 90 may be substantially shorter than the chamber of the Kallenbach patent. Indeed, some versions of valve 14 may be approximately fifty millimeters shorter than existing commercial diaphragm valves for automatic swimming pool cleaners, with a preferred version of valve 14 having a length of one hundred two millimeters and a width of forty-four millimeters.

D. Co-Molding

Figure 10:
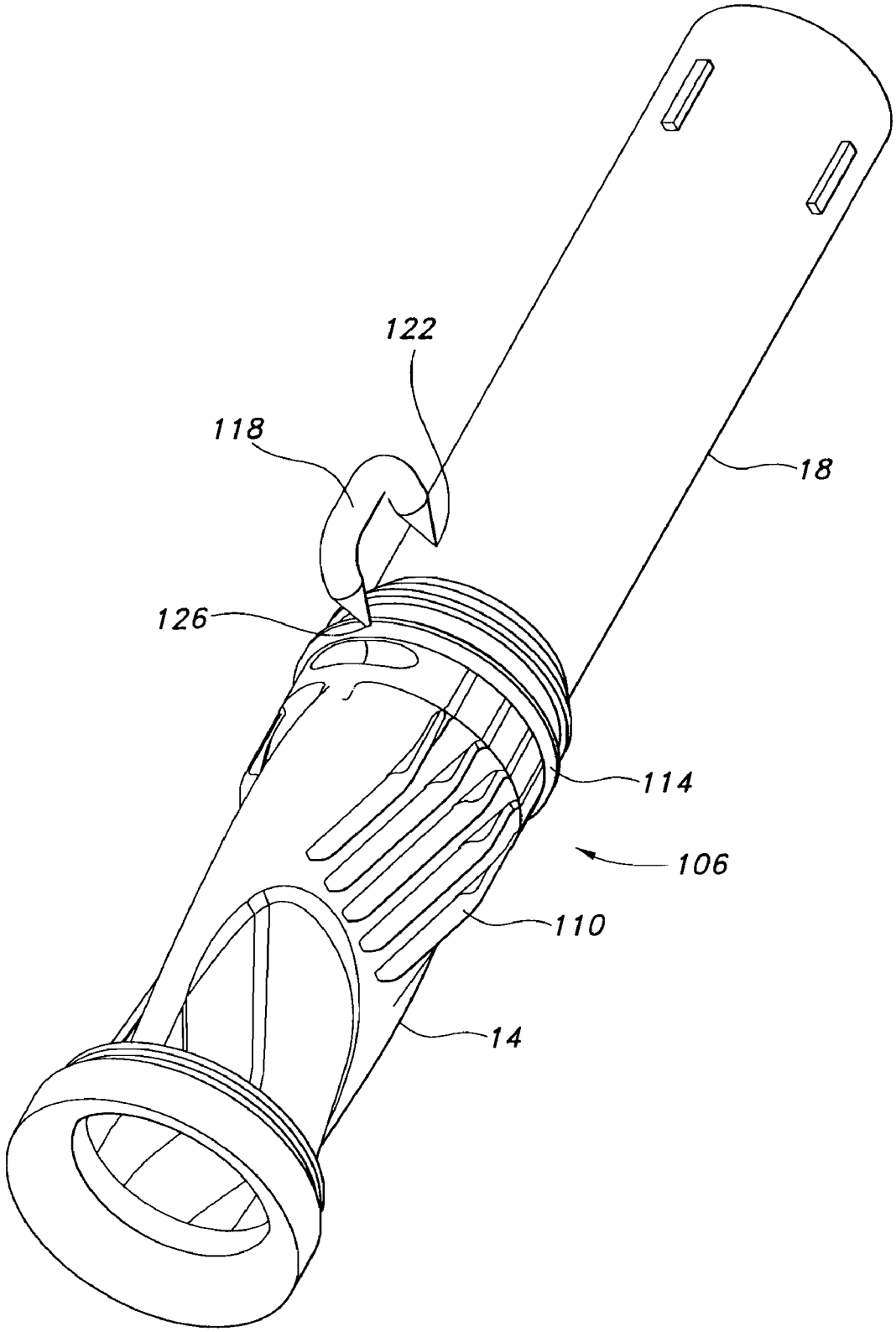
FIG. 10 is a perspective view of co-molded portions of the assembly of FIG. 1.

FIG. 10, finally, depicts inner pipe 18 co-molded with valve 14. Although preferably formed principally of differing materials, inner pipe 18 and valve 14 nevertheless may if desired be molded simultaneously and in a single mold. Such a mold could allow material of inner pipe 18 to flow into link 118 and thence to upper section 106, forming band 114 and ribs 110. After the materials of inner pipe 18 and valve 14 are fixed, set, or otherwise hardened into solids, link 118 easily may be removed (as, for example, by being snapped off at points 122 and 126).

The foregoing is provided for purposes of illustrating, explaining, and describing exemplary embodiments and certain benefits of the present invention. Modifications and adaptations to the illustrated and described embodiments will be apparent to those skilled in the relevant art and may be made without departing from the scope or spirit of the invention.

What is claimed is:

1. A device for permitting fluid flow therethrough, comprising:

a. a conduit comprising a first material that is inflexible; and b. a valve co-molded with the conduit, the valve comprising the first material and a second material that is flexible and being formed principally of the second material.

2. A device according to claim 1 in which the valve further comprises an upper section including both the first material and the second material.

3. A device according to claim 2 in which the upper section comprises at least one rib formed, at least in part, of the first material.

4. A device according to claim 3 in which the at least one rib comprises a plurality of longitudinal ribs.

5. A device according to claim 4 incorporated into an automatic swimming pool cleaner.

6. An automatic swimming pool cleaner valve comprising:

a. a body formed of a flexible first material and defining an inlet, an outlet, and a flexible first section between the inlet and the outlet; and b. means, formed with or attached to the flexible first section and made of a relatively inflexible second material, for strengthening at least the flexible first section of the body.

7. An automatic swimming pool cleaner valve according to claim 6 subject in use to differential internal and external pressures and in which the strengthening means helps prevent collapse of the flexible first section when the valve is subject to the differential internal and external pressures.

8. An automatic swimming pool cleaner valve according to claim 7 further defining a second section, upstream of the first section, that assumes a substantially collapsed condition when the valve is not subject to the differential internal and external pressures.

9. An automatic swimming pool cleaner valve according to claim 6 in which the outlet is configured to communicate with a rigid pipe of an automatic swimming pool cleaner.

10. An automatic swimming pool cleaner valve according to claim 6 in which the outlet is configured to communicate with a rigid inner pipe of an automatic swimming pool cleaner having a rigid inner pipe and a rigid outer pipe circumscribing at least a portion of the rigid inner pipe.

11. An automatic swimming pool cleaner valve comprising:

a. a body formed of a flexible first material and defining an inlet and an outlet; and b. means, comprising at least one rib formed with or attached to the body and made of a relatively inflexible second material, for strengthening at least a portion of the body.

12. An automatic swimming pool cleaner valve according to claim 11 in which the body further defines a fluid flow passage between the inlet and the outlet, at least a portion of which is adapted cyclically to expand and collapse so as to vary periodically the flow of fluid through the passage.

13. An automatic swimming pool cleaner valve according to claim 12 in which, when no fluid pressure is applied, the expandable and collapsible portion of the fluid flow passage has a substantially elliptical transverse cross section.

14. An automatic swimming pool cleaner valve according to claim 13 in which the body further defines an exterior and the at least one rib is formed on or attached to the exterior.

15. An automatic swimming pool cleaner valve according to claim 14 in which the at least one rib is oriented longitudinally.

16. An automatic swimming pool cleaner valve according to claim 15 in which the at least one rib is formed of substantially rigid thermoplastic material.

17. An automatic swimming pool cleaner valve according to claim 16 in which the at least one rib is formed of metal.

* * * * *